US006508097B2

(12) United States Patent
Ose

(10) Patent No.: US 6,508,097 B2
(45) Date of Patent: Jan. 21, 2003

(54) MODULAR SYSTEM FOR EXPANDING AND REDUCING TUBING

(75) Inventor: Paul N. Ose, Ramsey, MN (US)

(73) Assignee: Airmo, Inc., Minneapolis, MN (US)

( * ) Notice: Subject to any disclaimer, the term of this patent is extended or adjusted under 35 U.S.C. 154(b) by 0 days.

(21) Appl. No.: 09/788,825

(22) Filed: Feb. 20, 2001

(65) Prior Publication Data

US 2001/0035038 A1 Nov. 1, 2001

Related U.S. Application Data

(60) Provisional application No. 60/205,950, filed on May 19, 2000.

(51) Int. Cl.[7] ..... B21D 41/02

(52) U.S. Cl. ..... 72/312; 72/316; 72/318; 72/370.06; 72/370.1

(58) Field of Search ..... 72/318, 316, 312, 72/453.18, 370.01, 370.02, 370.06, 370.08, 370.1, 370.22, 370.13

(56) References Cited

U.S. PATENT DOCUMENTS

| | | | | | |
|---|---|---|---|---|---|
| 2,438,999 | A | | 4/1948 | Hartley et al. | |
| 2,464,510 | A | * | 3/1949 | Hull | 72/312 |
| 2,465,677 | A | | 3/1949 | Deverall | |
| 2,654,414 | A | | 10/1953 | Tomarin | |
| 2,993,522 | A | * | 7/1961 | Temple | 72/312 |
| 2,998,125 | A | | 8/1961 | Hahn et al. | |
| 3,021,546 | A | | 2/1962 | Walz | |
| 3,143,989 | A | | 8/1964 | Hermanns | |
| 3,192,758 | A | * | 7/1965 | Catlin | 72/316 |
| 3,393,549 | A | * | 7/1968 | Gregg | 72/312 |
| 3,505,846 | A | | 4/1970 | Smida | |
| 3,568,303 | A | | 3/1971 | Akio Ito et al. | |
| 3,820,375 | A | | 6/1974 | Koski | 72/318 |
| 3,969,964 | A | | 7/1976 | George et al. | 29/268 |
| 5,134,872 | A | | 8/1992 | Ose | 72/318 |
| 5,709,121 | A | * | 1/1998 | Camping | 72/316 |

* cited by examiner

*Primary Examiner*—Daniel D. Crane
(74) *Attorney, Agent, or Firm*—Moore & Hansen

(57) ABSTRACT

A modular endforming mechanism for modifying an end of a thin-walled malleable tube is herein disclosed. The modular endformer comprises a gripping module having a collet means for grasping a tube inserted into the gripping module. The gripping module may be coupled to one of an expansion module and a reducing/flaring modular. The expansion module is constructed and arranged to actuate a sizing mandrel, which is inserted into the interior of the end of a tube to expand the diameter of the end of that tube. A forming insert works in conjunction with the sizing mandrel to limit the expansion of the tube diameter under the influence of the sizing mandrel. The reducing/flaring modular is similarly constructed and arranged to actuate a forming die having a tapered inner surface that engages the exterior of a tube clamped in the collet means of the griping modular so as to reduce the outer diameter of the tube and a flaring tube having a frustoconical surface that engages the interior of the tube at a predetermined angle to flare the end of that tube.

12 Claims, 6 Drawing Sheets

MODULAR SYSTEM FOR EXPANDING AND REDUCING TUBING

CROSS REFERENCES TO RELATED APPLICATIONS

This application claims priority from U.S. provisional patent application No. 60/205,950, filed on May. 19, 2000.

FIELD OF THE INVENTION

This invention relates to a modular end-forming device, or end former, used to modify the geometry of the end of a tube. More particularly, the present invention relates to a modular device that can expand, reduce, or flare the ends of tubes having differing diameters and wall thicknesses such as those tubes used in air conditioning coils.

BACKGROUND OF THE INVENTION

Often it is necessary to modify the geometry of an end of a tube to facilitate the creation of a joint such as a slip joint used to join two lengths of tubing. Similarly, it is often necessary to flare the end of a tube for use in a compression fitting. Tubes that are modified in these manners are typically thin-walled and made of a malleable material such as copper.

One of the problems which is encountered in the assembly of tube devices is the need to quickly and efficiently join tubes together, either when the unit is assembled in the field or when repairs are made. Even in factory assembly, coil units require tubes to be joined and this procedure needs to be accomplished as effectively and efficiently as possible.

Fluid pressure devices operated by hydraulic pressure or pneumatic pressure are known, particularly for expanding tubes such as those used in air conditioning coils and the like. Several hydraulic devices have been developed which are suitable for tightly gripping one end of an elongated tube while simultaneously delivering a tube expanding fluid. Among these are U.S. Pat. Nos. 3,505,846; 3,813,751, 3,962,769; and 4,189,162. None of these patents describe devices which are suitable for expanding the ends of tubes.

Other prior art devices which are used to expand the ends of tubes are devices which include a split finger means which is inserted in the tube. As the split fingers expand or flair out the end of the tube, material is squeezed between the fingers, leaving longitudinally extending ridges or raised portions. These raised portions of material cause several problems, both in obtaining a good junction and strong seal, and in requiring the use of much more silver solder or other sealing material.

U.S. Pat. No. 5,134,872, issued to Paul N. Ose and hereby incorporated by reference and commonly assigned herewith, discloses a device for expanding the inner diameter of tube ends having varying wall thicknesses. However, this device is capable of expanding a tube diameter only and is not capable of reducing a tube's diameter or flaring the end of a tube.

Accordingly, it is an object of the present invention to provide a modular mechanism that utilizes interchangeable modules and tooling to effect the expansion, reduction, and flaring of tube ends. Another object of this invention is provide a modular mechanism that may modify tubes of various diameters and wall thicknesses.

These and other objectives and advantages of the invention will appear more fully from the following description, made in conjunction with the accompanying drawings wherein like reference characters refer to the same or similar parts throughout the several views.

SUMMARY OF THE INVENTION

A modular endformer according the present invention is capable of modifying a thin walled malleable tube by reducing the diameter thereof, expanding the diameter thereof, and by flaring or belling the end of the tube. In achieving this functionality, the endformer of the present invention is constructed and arranged to utilize common structures to alternatively actuate and operate an expanding tool, a reducing tool, and a flaring tool. As can be appreciated, the dimensions of the expansion tool, reducing tool and flaring tool may be varied to accommodate variously sized tubes.

The endformer of the present invention essentially comprises a body having a piston structure and a collet mechanism slidably disposed therein. The body has first and second inlet structures for a source of fluid under pressure. The body also has a tube-receiving end that allows a tube to be inserted therein.

The piston structure is longitudinally movable within the body between a first, retracted position and a second, extended position. The piston structure is moved to its first position by the introduction of a pressurized fluid into the first inlet structure, and is moved to its second position by introducing the pressurized fluid into the second inlet structure. The piston structure has coupled thereto an adjustment mechanism that provides for controlling the distance traveled by the piston structure between its first and second positions. The piston structure and adjustment mechanisms are constructed and arranged to actuate one of the aforementioned expanding tool, reducing tool, and flaring tool.

The collet mechanism is disposed within the body adjacent the tube receiving end thereof and engages and clamps a tube end within the body. The collet mechanism is arranged such that the tube end is engaged at a location spaced apart from the end of the tube. The collet mechanism is actuated to grasp the tube by the piston structure when pressurized fluid is introduced into the first inlet structure and actuated to release the tube by the pressurized fluid introduced into the body by the second inlet structure.

Preferably, the body of the endformer will comprise a first half and a second half with the piston structure of the endformer being disposed substantially within the first half of the endformer and the collet mechanism being disposed substantially within the second half of the end former.

The piston structure of the present invention essentially comprises a primary piston that is slidably received within a bore formed in an actuator piston that is itself slidably received within the body of the endformer. The primary piston moves longitudinally within the actuator piston between a first position and a second position under the influence of pressurized fluids introduced through the first and second inlet structures, respectively. The primary piston actuates the expanding tool as the primary piston moves from its first position to its second position. The actuator piston simultaneously actuates the collet mechanism so that the collet mechanism will grasp and hold the tube as the expanding tool engages the tube.

The expanding tool used with the present invention comprises a sizing mandrel coupled to the primary piston and a forming insert disposed within the body generally adjacent the tube receiving end thereof. The forming insert has an interior bore of a predetermined size formed therethrough that is sized to receive therein an end of the tube that will be modified. The sizing mandrel is arranged to be inserted into the tube end that is disposed within the forming insert as the primary piston moves from its first, retracted, position to its second, extended position, thereby expanding the diameter of the tube end to that of the forming insert.

The reduction tool of the endformer of the present invention comprises a forming die and a removal shoulder that are coupled to the piston structure of the endformer. The forming die is operatively coupled to the end of the primary piston and the removal shoulder is coupled to the end of an adjusting mechanism that is itself operatively coupled to the primary piston independent of the forming die. The forming die has an interior tapered bore of a predetermined size and shape that when addressed to the end of a tube received within the body of the endformer, will reduce the outer diameter thereof. The forming die is actuated into contact with the end of a tube as the primary piston moves from its first position to its second position. As the primary piston moves back to its first, retracted position from its second, extended position, the removal shoulder acts to push a tube out of the tapered bore of the forming die as the forming die moves past the removing shoulder.

The flaring tool that is used with the endformer of the present invention comprises a flaring die that is coupled to the piston structure. The flaring die has a frustoconical surface having a predetermined angle that is constructed and arranged to engage the end of a tube received within the tube receiving end of the body as the piston structure moves from a first retracted position to a second extended position. When it operatively addresses the end of the tube, the frustoconical surface of the flaring die acts to flare out the end of the tube.

The collet mechanism of the endformer of the present invention essentially comprises a plurality of collet jaws that are operatively coupled to the piston structure of the endformer such that the collet jaws may travel longitudinally therewith. The collet jaws are further constructed and arranged to move in a radial direction with regard to the piston structure so as to permit the collet jaws to come into clamping contact with a tube end inserted into the tube receiving end of the body of the endformer. The collet mechanism may be used with each of the expanding tool, reducing tool, and flaring tool.

A preferred embodiment of the collet mechanism of the present invention comprises a collet actuator, a return collet and a plurality of collet jaws. The collet actuator is slidably disposed within a bore formed through a first section of the endformer. The return collar is also slidably disposed within the bore formed through the first section of the endformer and is coupled to the collet actuator so as to move therewith. The collet jaws are operatively coupled to the collet actuator and are constructed and arranged to move longitudinally with the collet actuator and to also move radially with respect to the collet actuator. The collet jaws of the endformer move radially inwardly so as to clamp a tube received within the body of the endformer when the collet jaws are brought into contact with an inner surface of the body of the endformer. This occurs as the collet mechanism moves from its first, retracted position, to its second, extended position.

DETAILED DESCRIPTION

Although the disclosure hereof is detailed and exact to enable those skilled in the art to practice the invention, the physical embodiments herein disclosed merely exemplify the invention, which may be embodied in other specific structure. While the preferred embodiment has been described, the details may be changed without departing from the invention, which is defined by the claims.

Figures 1, 2:
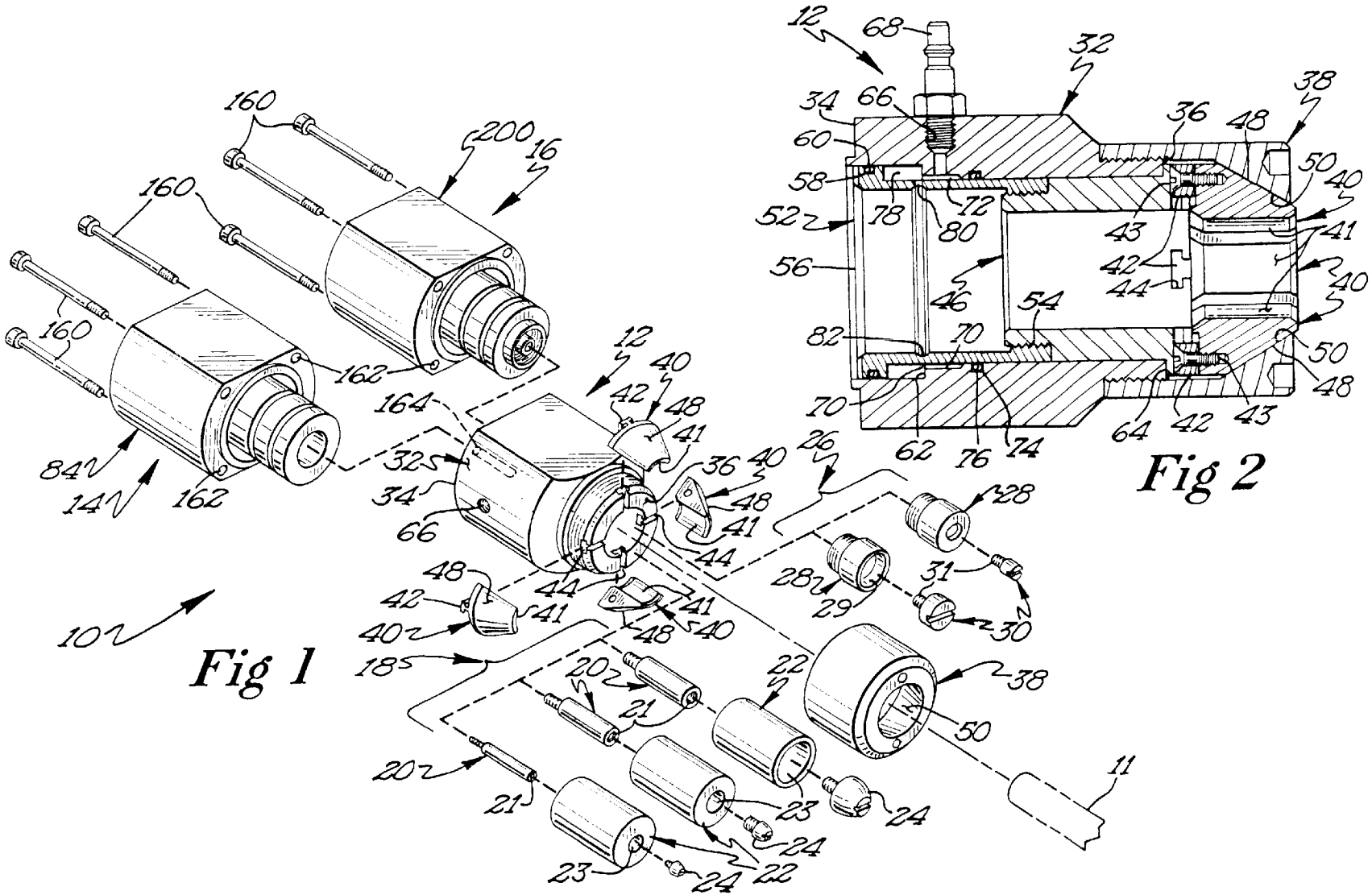
FIG. 1 is an exploded perspective view of the modular end former of the present invention along with a selection of end forming tooling that may be used therewith.
FIG. 2 is a sectional view of a side elevation of the gripping module of the end former.
Figure 5:
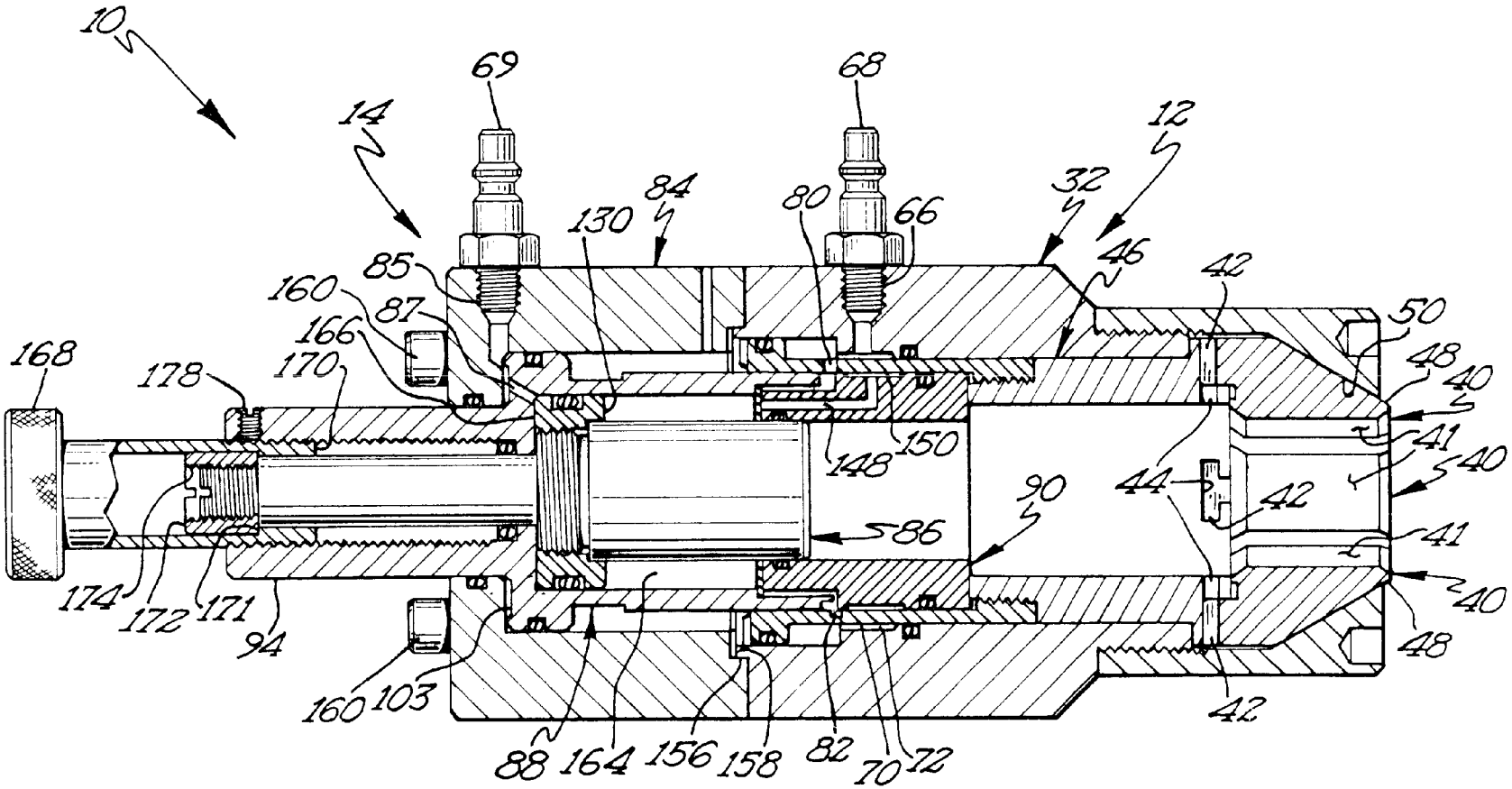
FIG. 5 is a sectional view of a side elevation of an assembled end former configured with an expansion module and a gripping module.
Figure 6:
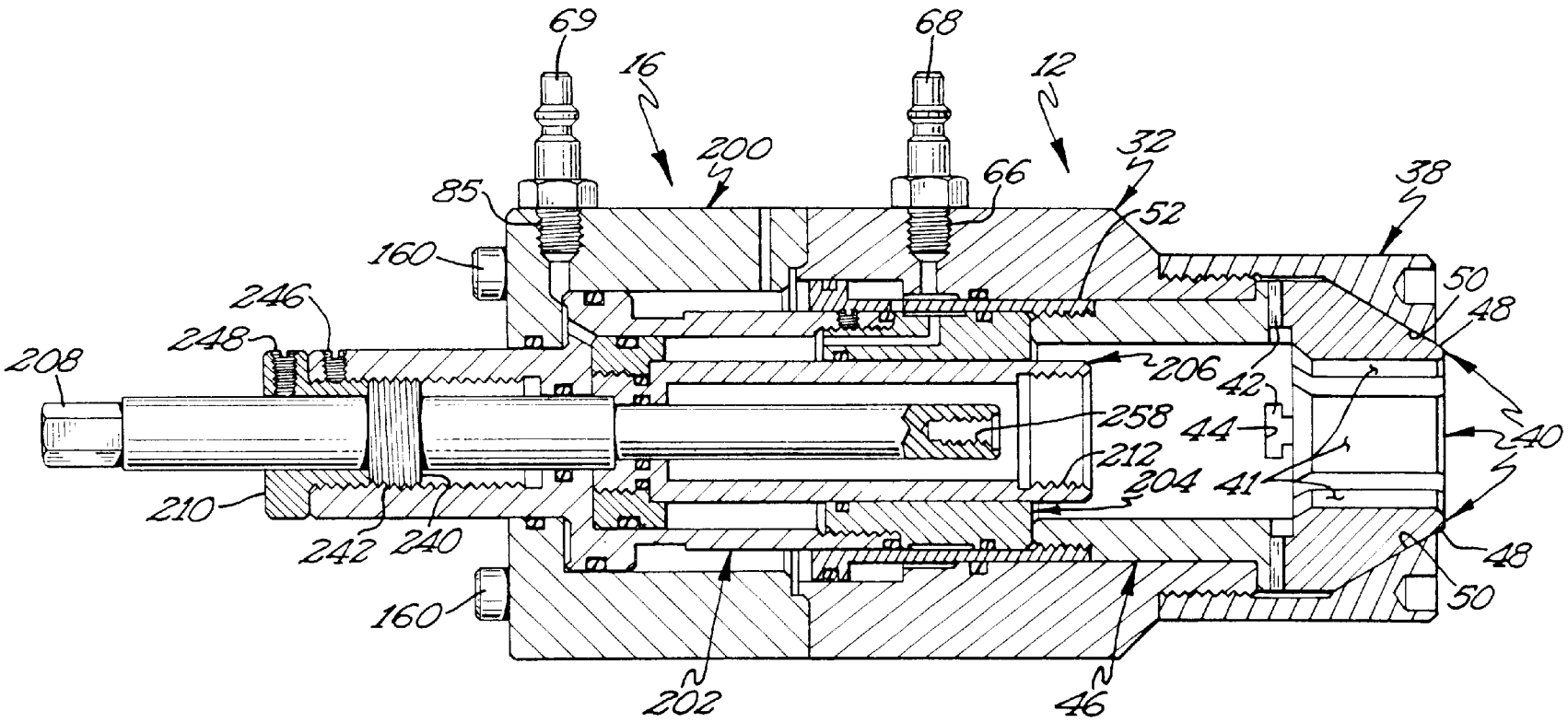
FIG. 6 is a sectional view of a side elevation of an assembled end former configured with a reducing module and a gripping module.

Referring to FIG. 1, it can be seen that the modular end former 10 of the present invention comprises a gripping module 12, an expanding module 14, and a reducing module 16. The end former 10 may be configured to expand the end of a tube 11 by bolting the expanding module 14 to the gripping module 12 as illustrated in FIG. 5. Similarly, the end former 10 may be configured to expand or flare the end of a tube 11 by bolting the reducing module 16 to the gripping module 12 as illustrated in FIG. 6. Also illustrated in FIG. 1 is an expansion tool 18 that is constructed and arranged for use with the expanding module 14. The expansion tool 18 comprises a piston extension 20, a forming insert 22, and a sizing mandrel 24, the construction and use thereof being described in greater detail herein below.

Figure 8A:
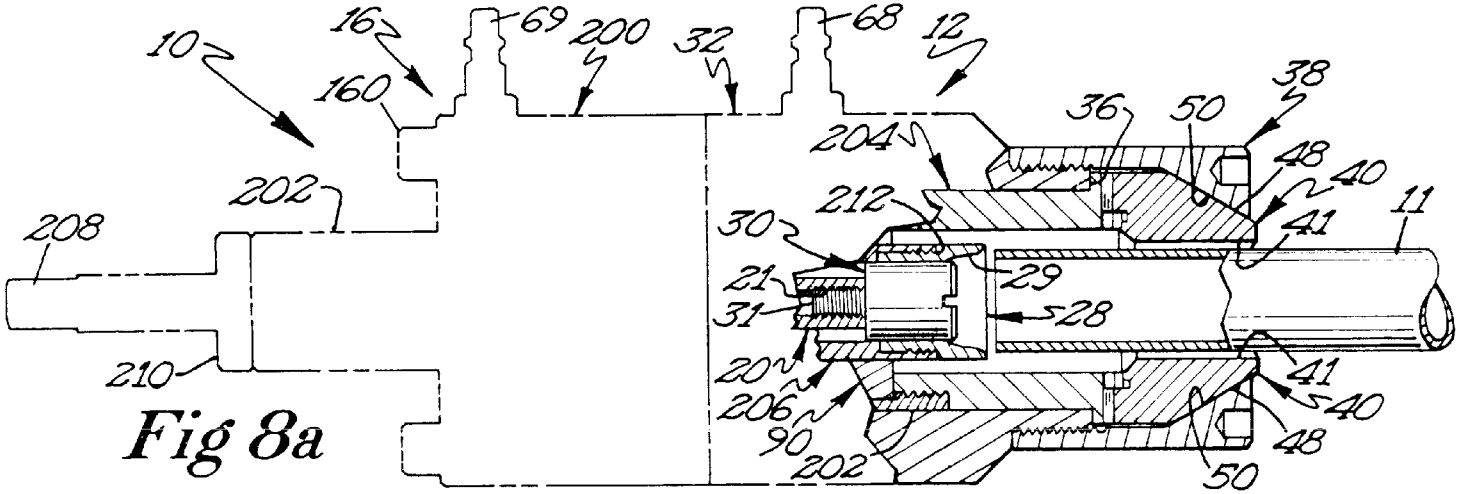
Figure 8B:
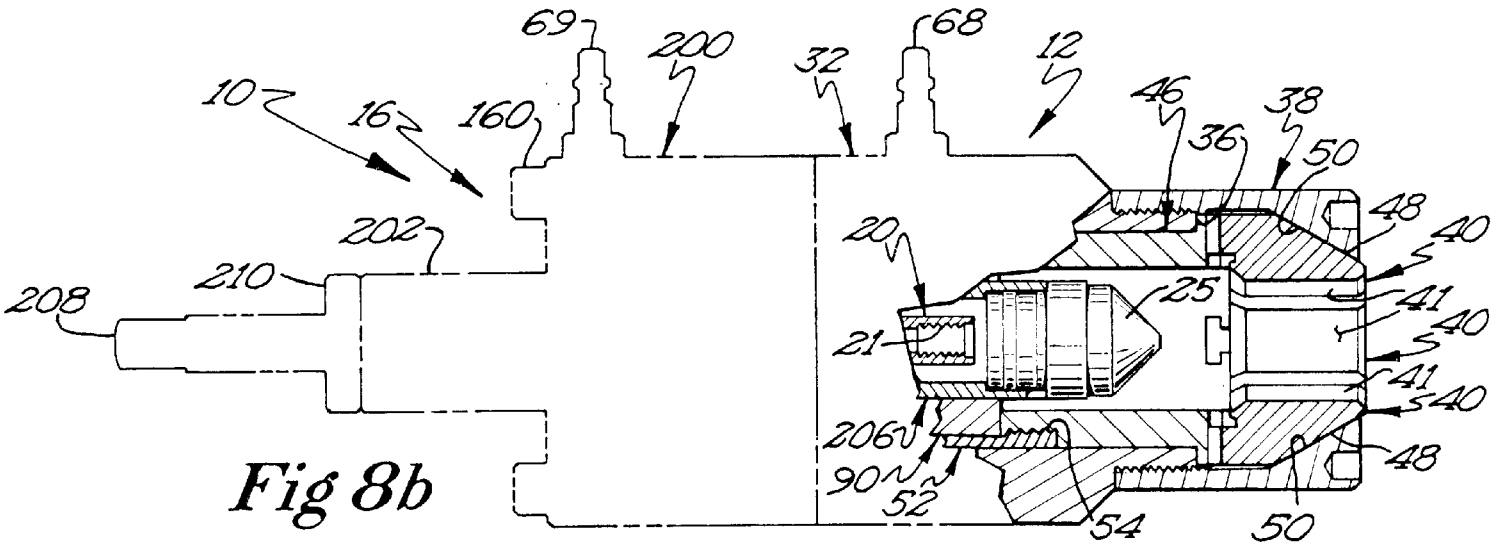

Also illustrated is a reducing tool 26 that is used with the reducing module 16 to reduce the diameter of the end of a tube 11. The reducing tool 26 is comprised of a forming die 28 and removal shoulder 30, the construction and use thereof being described in more detail herein below. A flaring tool or flaring die 25 is illustrated in FIG. 8*b*. It is to be noted that by varying the dimensions of the respective expansion, reducing, and flaring tools 18, 20, and 25, it is possible to utilize the modular end former 10 of the present invention with diverse tubes 11 having varying diameters and wall thickness.

FIG. 2 illustrates in more detail the construction of the gripping module of the end former 10. The gripping module 12 is made up of a body 32 having a base 34 and an end 36. The outer surface of the end 36 is threaded so that a front cap 38 may be threadedly secured to the body 32 of the gripping module 12. The body 32 and front cap 38 have a bore formed therethrough that is sized to receive a collet means for grasping and retaining the end of a tube 11 that is to be modified. The collet means comprises a plurality of collets or collet jaws 40 that are secured to a collet actuator 46. Each of the collets 40 has a tab 42 extending from the base thereof that is slidably received in a radially oriented slot formed in the end face of the collet actuator 46. Each of the tabs 42 and their corresponding radial slots 44 have in this embodiment a "T" shape that constrain the collets 40 to move axially along with the collet actuator 46. The collets 40 have a radially inwardly tapered surface 48 that abuts the correspondingly tapered inner surface 50 of the front cap 38. The surfaces 48, 50 cooperate to translate axial movement of the collet actuator 46 into radial movement of the collets 40. As the collet actuator 46 moves axially towards the front cap 38, the collets are forced radially inward due to the interaction between the surfaces 48, 50. In this manner, a tube 11 inserted into the bore of the gripping module 12 will be securely gripped by the collets 40. In order to securely grasp a tube 11 received within the gripping module 12, it is preferred to utilize four collets 40, each collet 40 spanning an arc approaching 90 degrees. In this manner, the cylindrical clamping faces 41 of the collets 40 will contact the end of a tube 11 around substantially its entire circumference. The even contact between the collets 40 and the tubing 11 prevents damage to the tubing. The clamping faces 41 of the collets may be smooth or may be roughened to improve the grip that the collets 40 may exert upon the tubing 11.

Tabs 42 of collets 40 are in this embodiment "T" shaped. However, it must be understood that any shape which would constrain the collets 40 to move axially with the collet actuator 46 may be used. Furthermore, tabs 42 may be formed integral with the body of the collets 40 or may be secured to the collets 40 by means of screw of bolt 43 as illustrated in FIG. 2.

The collet actuator 46 is secured to return collar 52 by threads 54. The return collar 52 has at its base end a radially outwardly extending annular ring 56. Annular ring 56 has formed in its outer surface a groove 58 that contains a sealing mechanism such as an O-ring 60. Throughout this description the term O-ring is to be construed broadly to encompass any and all suitable sealing mechanisms. The annular ring 56 limits the forward movement of the collet actuator 46 and collets 40 by abutting against a shoulder 62 formed within the bore of the gripping module body 32. Rearward motion of the collet actuator 46 and collets 40 is limited by the end 36 of the gripping module body 32. As can be seen in FIG. 2, the central portion of the collet actuator 46 has a diameter that is smaller than that portion into which the radial slots 44 are formed. A transition between the central portion of the collet actuator 46 and its end portion forms shoulder 64 which bears against the end 36 of the body 32 of the gripping module.

The body 32 of the gripping module has a port 66 formed through the side thereof and includes a connector 68 which allows a supply of pressurized fluid, preferably hydraulic fluids, to be connected to the port 66. Port 66 communicates with the bore formed through the gripping module 12, opening onto a shallow circumferential channel 70 formed in the body 32 of the gripping module. Channel 70 and return collar 52 define a small annular cavity 72 around the entire circumference of the return collar 52. Immediately adjacent the circumferential channel 70 and on the side of the channel nearest the front cap 38, a circumferential groove 74 is formed into the body 32 of the gripping module 12. An O-ring or other seal 76 is disposed within the groove 74 so as to form a seal between the body 32 and return collar 52. The circumferential channel 70 opens into a second annular cavity 78 formed between the shoulder 62 of the body 32 and the annular ring 56 of the return collar 52. As can be appreciated, when the return collar 52 and collet actuator 76 are in a first, retracted position as illustrated in FIG. 2, the second annular cavity 78 is at its maximum size. When the return collar 52 and collet actuator 46 are in a second, extended position, annular ring 56 will approach or contact shoulder 62 and the volume of the annular cavity 78 will be minimized.

A small port 80 is formed through the wall of the return collar 52 and fluidically connects port 66 with a circumferential groove 82 formed around the hollow interior of the return collar 52.

Figure 3:
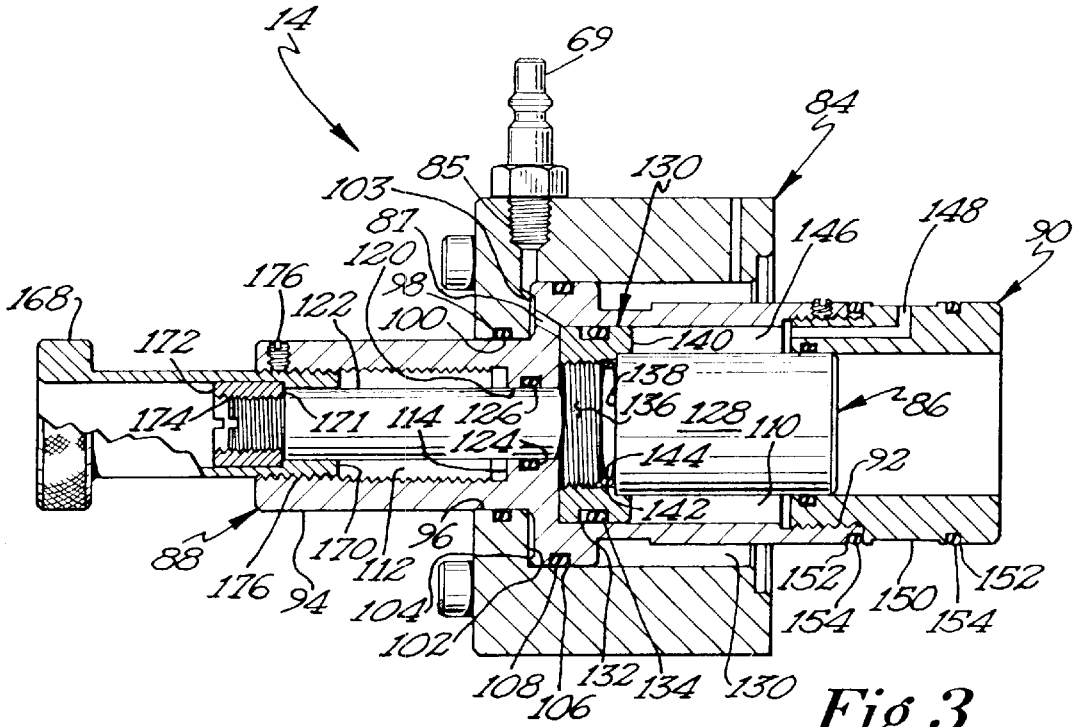
FIG. 3 is a sectional view of a side elevation of an expansion module of the end former of FIG. 1.

The expanding module 14 is best illustrated in FIGS. 3 and 5. The expanding module 14 comprises a body 84 having a bore formed therethrough that is sized to receive a piston means that actuates the collets 40 in the gripping module and which also actuates expansion tool 18. Note that FIGS. 3 and 5 are illustrated without expansion tool 18. The piston means of the expanding module 14 comprise a primary piston 86, an actuator piston 88, and an actuator nose 90. Primary piston 86 is slidably received within a bore formed through actuator piston 88. Actuator nose 90 is threaded into actuator piston 88 at threads 92. Actuator piston 88 has a shaft 94, which extends through an aperture 96 formed in the bottom of the body 84 of the expanding module. A circumferential groove 98 formed in the aperture 96 has an O-ring 100 disposed therein in order to created a seal between the shaft 94 and aperture 96. The shaft 94 of the actuator piston 88 is sufficiently long to produce an axial or longitudinal stroke long enough to actuate the collets 40 so that they may grip a tube 11 received within the gripping module 12. Interior to the aperture 96 the diameter of the bore formed in the body 84 of the expanding module expands to form a shoulder 102. Shoulder 104 of the actuator piston 88 abuts shoulder 102 of the body 84. The outer diameter of the actuator piston 88 is sized to create a close fitting relationship with the interior diameter of the bore formed through the body 84 of the expanding modular. A circumferential groove 106 is formed around the outer diameter of the actuator piston 88 and has an O-ring 108 disposed therein to form a seal between the body and the actuator piston.

Like the body 84 of the expanding module 14, the actuator piston 88 also has a bore formed completely therethrough. The bore formed through the actuator piston 88 can be divided into a interior portion 110 which is disposed within the interior of the body 84 of the expanding module 14 and an exterior portion 112 which is disposed within the shaft 94 of the actuator piston 88 and which extends exterior to the body 84 of the expanding module. Between the interior and exterior portions 110, 112 of the bore in the actuator piston 88 exists a ridge 114. Ridge 114 forms a shoulder 116 at the bottom of the interior portion 110 of the bore formed through the actuator piston 88 and a shoulder 118 at the bottom of the exterior portion of the bore formed through the actuator piston. Ridge 114 also defines an aperture 120 through which a shaft portion 122 of the primary piston 86 is received. The shaft portion 122 of the primary piston is thereby substantially disposed within the exterior portion 112 of the bore formed the actuator piston 88. A circumferential groove 124 formed around the aperture 120 has disposed therein an O-ring 126, which forms a seal between the shaft 122 of the primary piston and the aperture 120. An interior portion or body 128 of the primary piston 86 is disposed within the interior portion 110 of the bore formed through the actuator piston 88 and within a coaxial bore formed through the actuator nose 90. The diameter of the body 128 of the primary piston 86 is smaller than the interior diameter of the bore formed through the interior portion 110 of the actuator piston 88. In order to center the body 128 of the primary piston within the actuator piston and to provide a seal therebetween, a wear ring 130 is received around the body 128 of the primary piston 86 immediately adjacent the shaft portion 122 of the piston. A circumferential groove 132 formed around the wear ring 130 has received therein an O-ring 134, which forms a seal between the wear ring 130 and the interior diameter of that portion of the actuator piston 88. Preferably, the wear ring 130 will be threaded onto the body 128 of the primary piston 86 such as by threads 136. A shoulder 138 formed in the body 128 of the primary piston limits the movement of the wear ring 130 to the right as illustrated in FIG. 3. Wear ring 130 has a shoulder 140, which abuts shoulder 138 of the primary piston. It is also preferred to form a circumferential groove 142 in the body 128 of the primary piston immediately adjacent the shoulder 138. This circumferential groove has an O-ring 144 disposed therein to create a seal between the wear ring 130 and the body 128 of the primary piston.

An annular cavity 146 is defined by the outer surface of the body 128 of the primary piston 86, the interior surface of the interior portion 110 of the bore formed through the actuator piston 88, the wear ring 130, and the actuator nose 90. As can be appreciated, where the primary piston is in a first, retracted position as illustrated in FIG. 3, the annular cavity 146 is at its maximum size. Where the primary piston 86 has been actuated and moved to a second, extended position, the wear ring 130 will approach or contact the actuator nose 90, thereby minimizing the volume of the annular cavity 146. A port 148 is formed through the actuator nose 90 in order to provide a fluidic connection between the annular cavity 146 and a shallow channel 150 formed around the exterior circumference of the actuator nose 90. The channel 150 in the actuator nose 90 is bounded on either side by circumferential groove 152 having disposed therein O-rings 154.

In order to operate the end former 10 of the present invention, it is necessary couple the gripping module 12 to either an expanding module 14 or a reducing module 16. FIGS. 5 and 6 illustrate the gripping module 12 as it coupled to an expanding module 14 and a reducing module 16, respectively. As can be appreciated from the figures, the bodies of the expanding and reducing modules 14, 16 are substantially identical and therefore, mate with the body of the gripping module 12 in substantially the same way. With this mind, and for the purposes of brevity, only the connection between an expanding module 14 and the gripping module 12 will be described in detail.

Referring to FIG. 5, it can be seen that the body 32 of gripping module 12 has a cylindrical projection 156 extending from its base end. A corresponding cylindrical cavity 158 is formed into an end face of the body 84 of the expanding module 14 and receives the cylindrical projection 156 of the clamping modular 12 therein when the gripping module 12 and expanding module 14 are connected. It is preferred to provide a seal such as an O-ring between the mating faces of the expanding module and gripping module. Bolts 160 pass through bores 162 formed through the solid body 84 of the expanding module and are threaded into blind holes 164 formed in the body 32 of the gripping module 12, thereby securely clamping the gripping and clamping modules together.

Operation of the endformer 10 when configured to expand tubing 11 will be described in conjunction with FIG. 5. In operation, pressurized fluid is introduced into the expanding module 14 via fitting 69. This pressurized fluid causes the piston means disposed within the expanding module 14 to actuate the collet means of the gripping module 12 to grasp a tube 11 that has been inserted into the gripping module. FIG. 5 does not illustrate the expansion tool 18 that is typically used with the expansion module 14. Examples of the expansion tool 18 are illustrated in FIGS. 1 and 7. The pressurized fluid being introduced into fitting 69 will also cause the piston means to actuate the expansion tool 18 so as to expand the diameter of the tubing 11 in a desired manner. Once the desired diameter has been formed into the end of tubing 11, the flow of pressurized fluid into fitting 69 is cut off and pressurized fluid is then introduced into fitting 68 of the gripping module 12.

Pressurized fluid introduced into fitting 69 of the gripping module 12 causes the piston means within the expanding module 14 to be retracted to its initial position, thereby retracting the expansion tool 18 and releasing the collet means grip upon the tubing 11.

Figure 7A:
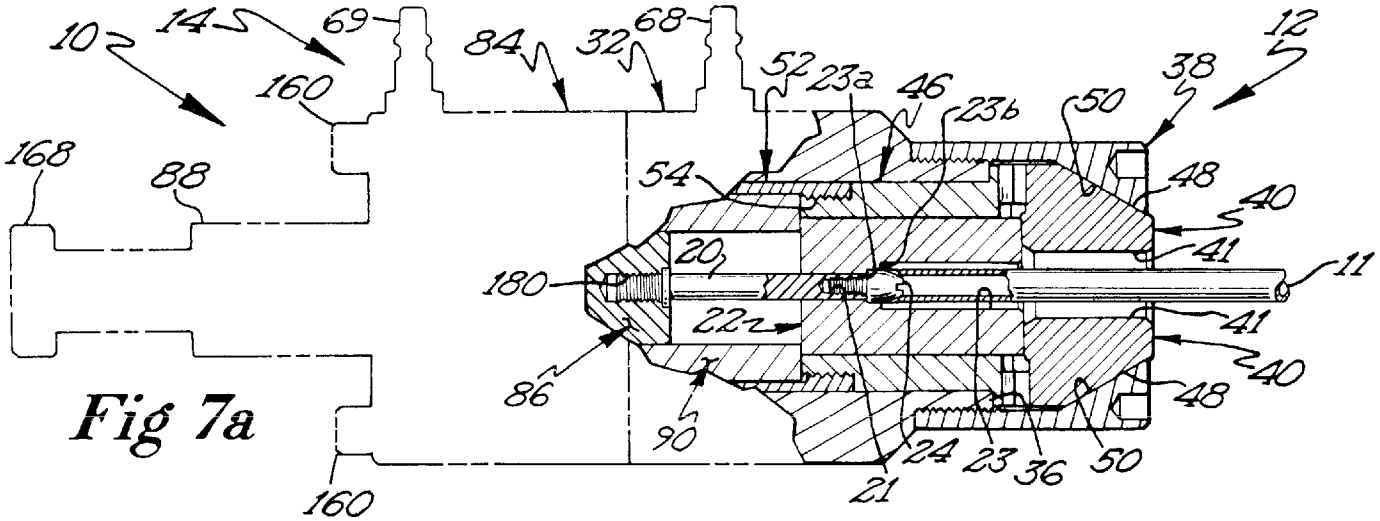
FIGS. 7*a* and 7*b* are partial cutaway views of a side elevation of an assembled end former configured with an expanding module and a gripping module and having a forming insert and sizing mandrel installed therein; and, FIGS. 8*a* and 8*b* are partial cutaway views of side elevations of an assembled end former configured with a reducing/flaring module and wherein a removal shoulder and forming die are installed in the end former of FIG. 8*a* and a flaring tool is installed in the end former of FIG. 8*b*.
Figure 7B:
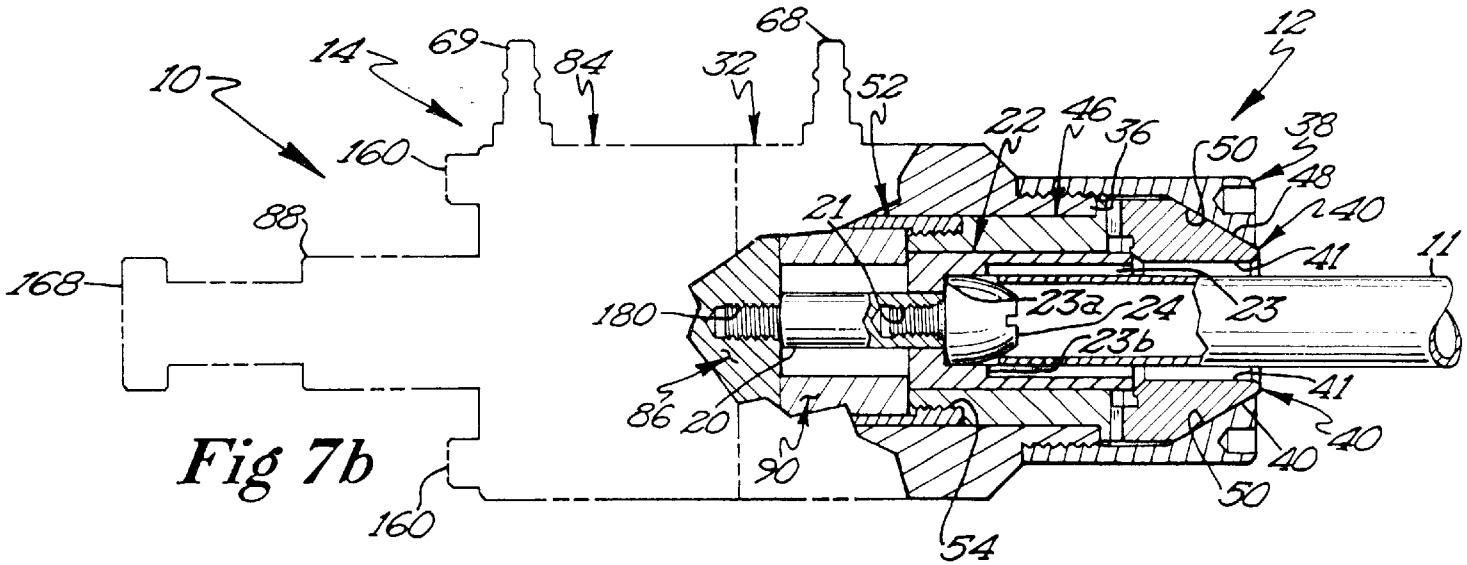

Specifically, in operation a tube or tubing 11 is inserted into the bore formed through the gripping module 12 as illustrated in FIGS. 7*a* and 7*b*. At this point, a pressurized fluid is introduced through fitting or connector 69 into port 85 that is formed through the wall of the body 84 of the expansion module 14. Port 85 is in fluidic communication with a shallow channel 103 formed on the shoulder 104 of the actuator piston 88. In this manner, the pressurized fluid acts to force the actuator piston 88 away from shoulder 102 and toward the gripping module 12. As the actuator piston 88 moves toward the gripping module, the actuator nose 90 secured to the actuator piston 88 contacts the collet actuator 46 and forces it to move axially in the direction of the front cap 38 of the gripping module 12. As described above, the axial motion of the collet actuator 46 is also experienced by the collets 40, and by the interaction between tapered surfaces 48, 50 on the collets and front cap, the axial motion is translated into inward radial motion of the collets 40. As the actuator piston 88 continues to move toward the gripping module 12, the collets 40 are forced radially inward into gripping contact with the tube 11 received within the gripping module 12.

A small port 87 is formed through the actuator piston 88 and fluidically connects the shallow channel 103 with an annular cavity defined by the wear ring 130 and the interior portion 110 of the bore formed through the actuator piston 88. Pressurized fluid entering the annular cavity formed between the actuator piston 88 and the wear ring 130 forces the primary piston 86 to move axially toward the gripping module 12. The relative sizes of the ports 85, 87 and channel 103 help to insure that the actuator piston 88 will actuate the collet means to firming grasp the tubing 11 before the primary piston 86 can bring the expansion tool 18 into contact with the tubing 11. Ideally the primary piston 86 will not move with respect to the actuator piston 88 until such time as the actuator piston has fully actuated the collet means to grasp the tubing 11. However, the stroke of the primary piston 86 with respect to the actuator piston 88 may begin prior to the full actuation of the collet means.

The stroke of the actuator piston 88 is limited by the amount of axial travel necessary to bring the collets into firm gripping contact with the tube 11, or by the limited range of motion of the collet actuator 46 within the body 32 of the gripping module 12. Full extension of the primary pistons 86 allows the expansion tool 18 to modify the tubing 11 clamped within the collet means of the gripping module 12 as illustrated in FIG. 7.

Once full extension of the primary piston 86 has been achieved, the supply of pressurized fluid through fitting or connector 69 is cut off and a pressurized fluid is introduced into connector 68. The pressurized fluid moving into the endformer 10 through connecter 68 into ports 66 causes the primary and actuator pistons 86 and 88 to retract, thereby forcing the fluid that actuated these pistons out of the endformer 10 through port 85 and connector 69. Pressurized fluid from port 66 flows through circumferential channel 70 and into annular cavity 72. The presence of pressurized fluid in the annular cavity 72 causes the return collar 52 to move to its retracted position adjacent the expansion module 14. Simultaneously, pressurized fluid passes through port 80 and into circumferential groove 82. Actuator nose 90 has a shallow channel 150 formed in its surface opposite the circumferential groove 82 formed in the interior of the return collar 52. Channel 150 is wide enough such that there is fluid communication between the groove 82 and channel 150 throughout the entire retracting stroke of the piston means. Pressurized fluid passes through the port 148 in the actuator nose 90 and enters the cavity 164 where the pressurized fluid forces the wear ring 130 into the bore formed through the actuator piston 88 until the wear ring 130 abuts an interior shoulder 166 of the actuator piston 88.

Where the stroke of actuator piston 88 is ultimately limited by the travel of the collet actuator 46, the stroke of the primary piston 86 is limited by interior shoulder 166 and a stroke adjustment means coupled to the end of the primary piston 86. The stroke adjustment means is comprised of an adjustment knob 168 having a cylindrical bore formed there through. Near the tip 170 of the adjustment knob 168 the bore formed through the adjustment knob is sized to slidably receive therein the shaft of the primary piston 86. The adjustment knob 168 is retained on the shaft of the primary piston 86 by an adjustment retainer 172 that is threaded onto the end of the shaft of the primary piston 86 at threads 174. While the shaft of the primary piston 86 slides freely through the bore of the adjustment knob 168, the adjustment knob itself is retained within the exterior portion 112 of the bore formed through the actuator piston 88 by threads 176. In general, the adjustment knob 168 may be threaded deeper into the exterior portion of the bore formed through the actuator piston 88 in order to provide a longer stroke for the primary piston 86, and may be backed out of the exterior portion of the bore through the actuator piston 88 in order to shorten the stroke of the primary piston 86. In operation, as the primary piston 86 moves from its retracted position to its extended position, the adjustment retainer 172 will abut a shoulder 171 formed within the cylindrical bore of the adjustment knob 168. Shoulder 171 prevents the primary piston 86 from being extended any further. In order to prevent the inadvertent modification of the stroke length of the primary piston 86, a set screw 178 is passed through a bore formed through the shaft of the actuator piston such that the set screw will contact the adjust knob 168.

Two version of an expansion tool 18 are illustrated in FIGS. 7*a* and 7*b*. The expansion tools 18 illustrated in FIGS. 7*a* and 7*b* are substantially identical with only the dimensions being variable. As can be appreciated, by changing the relative sizes of the piston extension 20, the forming insert 22, and the sizing mandrel 24, variously sized tubes 11 may be modified using a single modular end former 10. The installation of the expansion tool 18 is straight forward with the piston extension 20 being threadedly received within a threaded bore 180 formed in the end of the primary piston 86. The piston extension 20 is long enough to extend past the end of the actuator nose and into the cylindrical bore of the collet actuator 46. With the front cap 38 of the gripping module 12 removed and the collets 40 moved radially outward, a forming insert 22 may be inserted into the cylindrical bore of the collet actuator 46. The forming insert 22 is sized to create a close sliding fit with the bore of the collet actuator. The forming insert 22 is retained within the collet actuator 46 by the collets 40 which are slid radially inward to partially occlude the end of the bore formed through the collet actuator 46. A stepped bore 23 is formed entirely through the forming insert 22. Sizing mandrel 24 is inserted into the stepped bore 23 and threaded into threaded bore 21 formed in the end of the piston extension 20. The base of the sizing mandrel 24 abuts shoulder 23A within stepped bore 23. An additional shoulder 23*b* is formed within the stepped bore 23 to allow for expansion of the material of the tube wall. Shoulder 23*b* also aids in pushing a modified tube 11 off the sizing mandrel 24 as the primary piston 86 retracts. As can be seen from a comparison of FIG. 7A and 7B, it may also be necessary to utilized collets 40 of slightly different dimensions in order to more securely grasp variously sized tubes 11. For example, in FIG. 7A the expansion tool 18 is arranged to expand a tube 11 that is relatively small. Therefore, the collets 40 illustrated in FIG. 7A are correspondingly larger so as to be able to grasp the smaller tube 11. In FIG. 7B, the converse is true; a relatively large tube 11 is to be grasped, thereby requiring correspondingly smaller collets 40.

Figure 4:
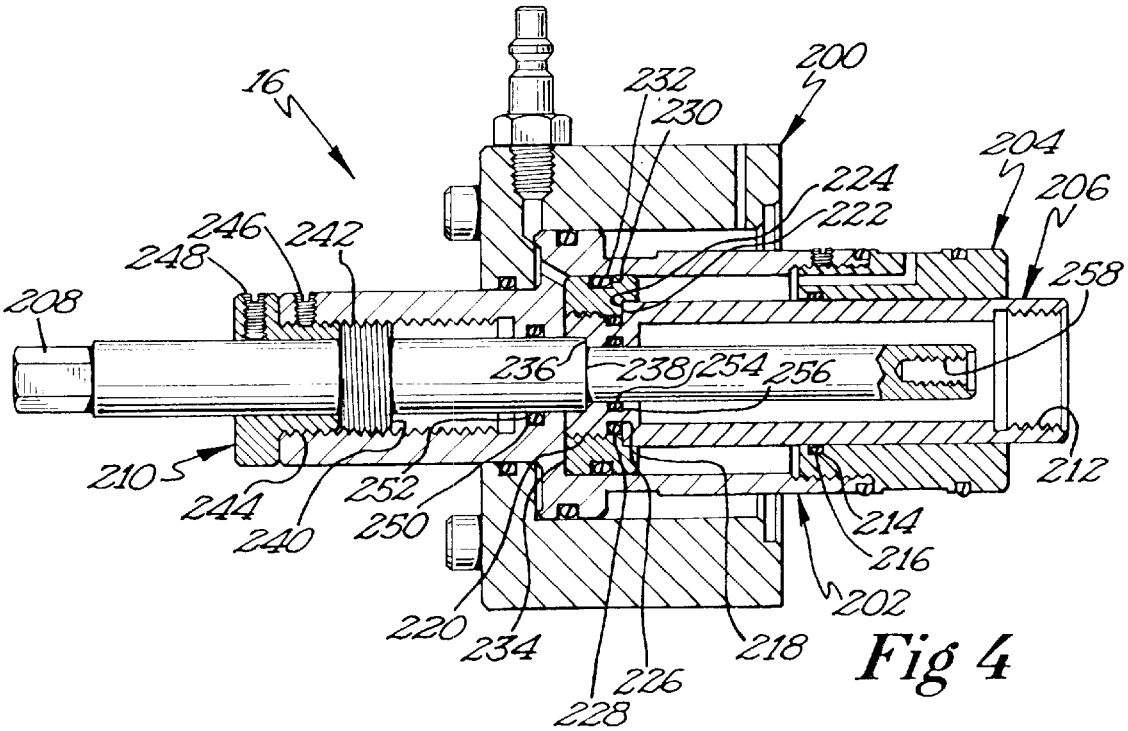
FIG. 4 is a sectional view of a side elevation of a reducing module of the end former of FIG. 1.

It is important to note that by utilizing forming inserts 22 having varying inner diameters, and by matching these forming inserts 22 with appropriately sized sizing mandrels 24, the end former 10 can expand the ends of virtually any sized tube 11 within a given range. Use of the forming inserts 22 also helps to control the outer diameter of the tubing 11 being modified and ensures that the tube end will be straight once modified. Furthermore, the length of tubing 11 that may be expanded by an expanding tool 18 is continuously variable over a given range of preferably zero to 1 inch, though it is contemplated that a larger piston stroke may increase this range. Where desired, the geometry of the end former 10 may be modified so as to provide a larger or smaller range.

Where the modular end former 10 is to be utilized to either reduce the diameter or flare the end of a tube, the gripping module 12 will be connected to the reducing module 16 in the same manner as the expanding module 14 was secured to the gripping module 12. Referring now to FIG. 4, a reducing module 16 according to the present invention is illustrated. It is to be understood that the principle of operation and in many cases the structure of the reducing module 16 are identical to those of the expanding module 14. The differences between the expanding module 14 and the reducing module 16 stem from the nature of the reducing tool 26 that is used to reduce the diameter of a tube 11 and a flaring tool 25 used to flare the ends of a tube 11.

The reducing module 16 comprises a body 200 that is substantially identical to the body 32 of the gripping module 12. Similarly, the piston means of the reducing module 16 comprises an actuator piston 202 and an actuator nose 204 which are also substantially identical to the actuator piston 88 and actuator nose 90 of the expanding module 14. The differences between the expanding and reducing modules is therefore limited to differences in the primary piston and the adjusting means. Therefore, only the adjustment means and the primary piston 206 of the reducing module 16 will be discussed in detail.

The primary piston 206 of the reducing module 16 is slidably received within a bore formed by the actuator piston 202 and actuator nose 204. The primary piston 206 is itself cylindrical and has a longitudinal stepped bore formed there through. A forming die 28 or flaring tool 25 may be threaded into the stepped bore of the primary piston 206 by threads 212 as illustrated in FIGS. 8A and 8B. A circumferential groove 214 having an O-ring 216 disposed therein is formed around the interior of the actuator nose 204 and forms a seal between the actuator nose and primary piston. A wear ring 218 is threaded onto a base end of the primary piston 206 by threads 220. The diameter of the primary piston 206 at threads 220 is slightly smaller than the remainder of the primary piston and forms a shoulder 222 against which a shoulder 224 of wear ring 218 abuts. A circumferential groove 226 formed around the exterior of the primary piston 206 adjacent shoulder 222 has an O-ring 228 disposed there which forms a seal between the wear ring and the primary piston. Similarly, a circumferential groove 230 formed around the exterior of the wear ring 218 has an O-ring 232 received therein, which forms a seal between the wear ring and the interior of the actuator piston 202.

The primary piston 206 reciprocates between a first retracted position in which the base of the primary piston 206 and wear ring 218 abut against a shoulder 234 of the actuator piston 202, and a second extended position in which the wear ring 218 abuts against the actuator nose 204. The length of the stroke of the primary piston 206 may be adjusted using the adjustment bolt 208 which is received through the body 200 of the reducing module 16 through the bore of the actuator piston 202 and into the bore formed through the primary piston 206. The adjustment bolt 208 has a shoulder 236 formed there around which abuts against a corresponding shoulder 238 formed the base of the primary piston 206. In operation, the adjustment bolt 208 does not move with respect to the actuator piston 202. This is accomplished by means of collar 240, which threadedly engages the interior of the actuator piston 202 at 242. That portion of the bore formed through the actuator piston 202, which extends exterior to the body 200 of the reducing module 16, is threaded over substantially its entire length. The end of the adjustment bolt 208 is formed in a manner, which would allow standard tools, such as a wrench, to be used to rotate the adjustment bolt 208. The retaining collar 210 has a bore formed therethrough and is received over the end of the adjustment bolt 208 and threaded into the bore of the actuator piston 202 by threads 244. A setscrew 246 prevents the retainer collar 210 from backing out of the bore of the actuator piston 202. Similarly, a setscrew 248 formed through the retainer collar 210 impinges upon the adjust bolt 202 to prevent the inadvertent movement of the adjustment bolt 208 with regard to the actuator piston 202. A groove 250 formed around the interior of the bore of the actuator piston 202 has retained therein an O-ring 252, which forms a seal between the actuator piston 202 and the adjustment bolt 208. A circumferential groove 254 formed around the interior bore of the primary piston 206 also has an O-ring 256 received therein which forms a seal between the interior of primary piston 206 and the adjustment bolt 208.

A threaded bore 258 formed in the end of the adjustment bolt 208 is constructed and arranged to receive the threaded shaft 31 of the removal shoulder 30 therein.

Where the modular end former 10 is configured with the reducing module 16 bolted to the gripping module 12 by bolts 160, and has a removal shoulder 30 threadedly attached to the adjustment bolt 208 and a forming die 28 threadedly attached to the primary piston 202, the endformer 10 may be utilized to reduce the other diameter of a tube 11 as illustrated in FIG. 8A. In FIG. 8A, the piston means of the end former 10 are in their retracted position, and tubing 11 has been inserted into the gripping module 12. At this stage, pressurized fluid introduced into connector 69 actuates the piston means of the reducing module 16 which in turn actuates the collet means of the gripping module 12 to firming grasp the tubing 11. Simultaneously, the primary piston 86 will move from its retracted position to its fully extended position. It is noted that the removal shoulder 30 that is secured to the adjustment bolt 208 remains stationary with regard to the actuator piston 202. As the primary piston 206 moves to its fully extended position, an inwardly tapered surface 29 of forming die 28 forces the walls of the tube 11 inwardly, thereby reducing the outer diameter of tubing 11. Once the primary piston 206 has reached its fully extended position, the supply of pressurized fluid to connection 69 is cut off and pressurized fluid is introduced into connecter 68, thereby causing the piston means of the reducing module 16 to retract to its first position. The pressurized fluid causes the return collar 52 of the gripping module 12 to retract the collet actuator 46 which in turn causes the collets 40 to release their grip on the tubing 11. Simultaneously, the primary piston 206 of the reducing module 16 retracts until the end of tubing 11 contacts the removal shoulder 30. As the retracting primary piston 206 moves the forming die 28 past the removal shoulder 30, the removal shoulder 30 effectively pushes the tubing 11 out of the forming die 28 so that the tubing 11 may be removed from the endformer 10.

Where the endformer 10 is configured for use in a flaring operation as illustrated in FIG. 8*b*, the forming die 28 and removal shoulder 30 are omitted in favor of a flaring tool 25 that is threaded into threads 212 in the primary piston 206. It can be appreciated from FIG. 8*b* that the forward stroke of the primary piston 206 will cause the flaring tool 25 to address the end of a tube 11 received within and firmly gripped by the collet means of the gripping module 12. The force exerted upon the end a tube 11 by the flaring tool 25 causes the tip of a tube 11 to be flared or belled out in a manner well known in the art. Retraction of the piston means of the reducing module 16 breaks the contact between the flaring tool 25 and the tube 11. Pressurized fluid flowing through connector 68 will cause return collar 52 to actuate the retraction of collets 40, thereby releasing the now-flared tube 11 from the gripping module 12.

In the same manner as described above in conjunction with the expansion tool 18, it can be appreciated that by varying the dimensions of the forming die 28, the removal shoulder 30, and the flaring tool 25, many different tubes 11 of varying sizes may be modified using a single modular end former 10.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A modular endformer for modifying the diameter of an end of a thin walled malleable tube comprising:

a body having first and second inlet structures for a source of fluid under pressure, said body further having a tube-receiving end;

a piston structure longitudinally movable between a first, retracted position, and a second extended position, the piston structure being moved to its first position by introducing fluid under pressure into the first inlet structure, and being moved to its second position by introducing fluid under pressure to the second inlet structure, the piston structure also having coupled thereto an adjustment mechanism for controlling the distance traveled by the piston structure between its first and second positions, the adjustment mechanism traveling with the piston structure as it moves between its first and second positions, the piston structure and adjustment mechanisms being constructed and arranged to actuate one of an expanding tool, a reducing tool, and a flaring tool, the expanding tool, reducing tool, and flaring tool being themselves constructed and arranged to expand the diameter of a predetermined length of a tube received within the tube receiving end of the body, to decrease the diameter of a predetermine length of the end of a tube received within the tube receiving end of the body, and flare of the tube received within the receiving end of a body, respectively; and, a collet mechanism disposed within the body adjacent the tube receiving end for engaging the tube at a location spaced apart from the end of the tube that is to be modified by one of the expanding tool, reducing tool, and flaring tool, the collet mechanism being actuated to grasp the tube by pressurized fluid introduced into the body through the first inlet structure and actuated to release the tube by pressurized fluid introduced into the body through the second inlet structure.

2. The modular endformer of claim 1 wherein the dimensions of the expansion tool, reducing tool and flaring tool may be varied to accommodate variously sized tubes.

3. A modular endformer for modifying the diameter of an end of a thin walled malleable tube comprising:

a body having first and second inlet structures for a source of fluid under pressure, said body further having a tube-receiving end;

a piston structure longitudinally movable between a first, retracted position, and a second extended position, the piston structure being moved to its first position by introducing fluid under pressure into the first inlet structure, and being moved to its second position by introducing fluid under pressure to the second inlet structure, the piston structure also having coupled thereto an adjustment mechanism for controlling the distance traveled by the piston structure between its first and second positions, the piston structure and adjustment mechanisms being constructed and arranged to actuate one of an expanding tool, a reducing tool, and a flaring tool, the expanding tool, reducing tool, and flaring tool being themselves constructed and arranged to expand the diameter of a predetermined length of a tube received within the tube receiving end of the body, to decrease the diameter of a predetermine length of the end of a tube received within the tube receiving end of the body, and flare of the tube received within the receiving end of a body, respectively, and wherein the dimensions of the expansion tool, reducing tool and flaring tool may be varied to accommodate variously sized tubes;

a collet mechanism disposed within the body adjacent the tube receiving end for engaging the tube at a location spaced apart from the end of the tube that is to be modified by one of the expanding tool, reducing tool, and flaring tool, the collet mechanism being actuated to grasp the tube by pressurized fluid introduced into the body through the first inlet structure and actuated to release the tube by pressurized fluid introduced into the body through the second inlet structure; and, wherein the piston structure further a primary piston slidably received within a bore formed in an actuator piston that is itself slidably received within the body of the endformer, the primary piston being constructed and arranged to actuate the expanding tool as the primary piston moves from a first position to a second position within the actuator piston, the actuator piston being constructed and arranged to actuate the collet mechanism so that the collet mechanism will grasp the tube.

4. The endformer of claim 3 wherein the expansion tool comprises a sizing mandrel coupled to the primary piston and a forming insert disposed within the body generally adjacent the tube receiving end of the body, the forming insert having an interior bore of predetermined size formed therethrough for receiving therein an end of the tube, the sizing mandrel being insertable into the tube disposed within the forming insert as the primary piston moves to its second, extended position.

5. A modular endformer for modifying the diameter of an end of a thin walled malleable tube comprising:

a body having first and second inlet structures for a source of fluid under pressure, said body further having a tube-receiving end;

a piston structure longitudinally movable between a first, retracted position, and a second extended position, the piston structure being moved to its first position by introducing fluid under pressure into the first inlet structure, and being moved to its second position by introducing fluid under pressure to the second inlet structure, the piston structure also having coupled thereto an adjustment mechanism for controlling the distance traveled by the piston structure between its first and second positions, the piston structure and adjustment mechanisms being constructed and arranged to actuate one of an expanding tool, a reducing tool, and a flaring tool, the expanding tool, reducing tool, and flaring tool being themselves constructed and arranged to expand the diameter of a predetermined length of a tube received within the tube receiving end of the body, to decrease the diameter of a predetermine length of the end of a tube received within the tube receiving end of the body, and flare of the tube received within the receiving end of a body, respectively, and wherein the dimensions of the expansion tool, reducing tool and flaring tool may be varied to accommodate variously sized tubes;

a collet mechanism disposed within the body adjacent the tube receiving end for engaging the tube at a location spaced apart from the end of the tube that is to be modified by one of the expanding tool, reducing tool, and flaring tool, the collet mechanism being actuated to grasp the tube by pressurized fluid introduced into the body through the first inlet structure and actuated to release the tube by pressurized fluid introduced into the body through the second inlet structure; and, wherein the piston structure further comprises a primary piston slideably received within an actuator piston, the primary piston being constructed and arranged to actuate the reducing tool as the primary piston moves from its first position to its second position, the actuator piston being constructed and arranged to actuate the collet mechanism so that the collet mechanism will grasp the tube.

6. The endformer of claim 5 wherein the reduction tool comprises a forming die coupled to an end of the primary piston, and a removal shoulder coupled to an end of the adjusting mechanism, the forming die having an interior tapered bore of a predetermined size and shape formed therethrough that engages the exterior of a tube received within the tube receiving end of the body as the primary piston moves from its first, retracted position to its second, extended position, the removal shoulder acting to push a tube out of the tapered bore of the forming die as the forming die moves past the removing shoulder in moving from its second extended position to its first retracted position.

7. The endformer of claim 2 wherein the flaring tool comprises a flaring die coupled to the piston structure, the flaring die having a frustoconical surface, the frustoconical surface of the flaring die acting to flare out the end of the tube when the flaring die is operatively addressed to the end of the tube.

8. The endformer of claim 1 wherein the collet mechanism comprises a plurality of collet jaws that are operatively coupled to the piston structure such that the collet jaws may travel longitudinally with the piston structure, the collet jaws being further constructed and arranged to move in a radial direction with regard to the piston structure so as to permit the collet jaws to come into clamping contact with a tube end inserted into the tube receiving end of the body of the endformer.

9. The endformer of claim 8 wherein the collet mechanism is constructed and arranged for use with one of the expanding tool, reducing tool, and flaring tool.

10. A modular endformer for modifying the diameter of an end of a thin walled malleable tube comprising:

a body having first and second inlet structures for a source of fluid under pressure, said body further having a tube-receiving end;

a piston structure longitudinally movable between a first, retracted position, and a second extended position, the piston structure being moved to its first position by introducing fluid under pressure into the first inlet structure, and being moved to its second position by introducing fluid under pressure to the second inlet structure, the piston structure also having coupled thereto an adjustment mechanism for controlling the distance traveled by the piston structure between its first and second positions, the piston structure and adjustment mechanisms being constructed and arranged to actuate one of an expanding tool, a reducing tool, and a flaring tool, the expanding tool, reducing tool, and flaring tool being themselves constructed and arranged to expand the diameter of a predetermined length of a tube received within the tube receiving end of the body, to decrease the diameter of a predetermine length of the end of a tube received within the tube receiving end of the body, and flare of the tube received within the receiving end of a body, respectively, and wherein the dimensions of the expansion tool, reducing tool and flaring tool may be varied to accommodate variously sized tubes;

a collet mechanism disposed within the body adjacent the tube receiving end for engaging the tube at a location spaced apart from the end of the tube that is to be modified by one of the expanding tool, reducing tool, and flaring tool, the collet mechanism being actuated to grasp the tube by pressurized fluid introduced into the body through the first inlet structure and actuated to release the tube by pressurized fluid introduced into the body through the second inlet structure, and wherein the collet mechanism further comprises:

a collet actuator slidably disposed within a bore formed through a first section of the endformer;

a return collar slidably disposed within the bore formed through the first section of the endformer and secured to the collet actuator; and, a plurality of collet jaws operatively connected to said collet actuator, the collet jaws being constructed and arranged to move longitudinally with the collet actuator and also radially with respect to the collet actuator.

11. The endformer of claim 10 wherein the body of the endformer further comprises a first half and a second half, the piston structure of the endformer being disposed substantially within the first half of the endformer and the collet mechanism being disposed substantially within the second half of the end former.

12. The endformer of claim 10 wherein the collet jaws move radially inwardly as the collet jaws are brought into contact with an inner surface of the body of the endformer as the collet jaws move from their first position to their second position.

* * * * *